US007021362B2

(12) United States Patent
Marcin, Jr. et al.

(10) Patent No.: US 7,021,362 B2
(45) Date of Patent: Apr. 4, 2006

(54) SHELLING APPARATUS AND METHODS FOR INVESTMENT CASTING

(75) Inventors: John J. Marcin, Jr., Marlborough, CT (US); Stephen D. Murray, Marlborough, CT (US); Carl R. Verner, Windsor, CT (US); Maria A. Herring, Mystic, CT (US); Lea D. Kennard, Manchester, CT (US); Donald D. Schofield, Columbia, CT (US); Richard L. Ritchie, Marlborough, CT (US); Reade R. Clemens, Plainville, CT (US); Michael K. Turkington, Manchester, CT (US); Delwyn E. Norton, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/205,399

(22) Filed: Aug. 17, 2005

(65) Prior Publication Data

US 2005/0274482 A1 Dec. 15, 2005

Related U.S. Application Data

(62) Division of application No. 10/729,333, filed on Dec. 5, 2003, now Pat. No. 6,966,354.

(51) Int. Cl.
*B22C 9/04* (2006.01)

(52) U.S. Cl. ..... 164/165

(58) Field of Classification Search ..... 164/516–519, 164/165–166

See application file for complete search history.

(56) References Cited

U.S. PATENT DOCUMENTS

| | | | | |
|---|---|---|---|---|
| 3,812,898 A * | 5/1974 | Horton | 164/516 |
| 5,967,218 A * | 10/1999 | Pergande et al. | 164/46 |
| 6,513,567 B1 * | 2/2003 | Collins et al. | 164/46 |

FOREIGN PATENT DOCUMENTS

| | | | |
|---|---|---|---|
| DE | 24 44 515 | * | 4/1976 |
| JP | 62-214849 | * | 9/1987 |

* cited by examiner

*Primary Examiner*—Kuang Y. Lin
(74) *Attorney, Agent, or Firm*—Bachman & LaPointe, P.C.

(57) ABSTRACT

An apparatus for shelling an investment casting pattern has a tank containing a coating material. There are means for holding the pattern immersed in the coating material. There may be means for vibrating the pattern during immersion of the pattern and a vacuum source coupled to the tank to withdraw air from at least one headspace of the tank.

17 Claims, 2 Drawing Sheets

SHELLING APPARATUS AND METHODS FOR INVESTMENT CASTING

CROSS-REFERENCE TO RELATED APPLICATION

This is a divisional application of Ser. No. 10/729,333, filed Dec. 5, 2003 is now U.S. Pat. No. 6,966,354, and entitled "SHELLING APPARATUS AND METHODS FOR INVESTMENT CASTING".

BACKGROUND OF THE INVENTION

The invention relates to investment casting. More particularly, the invention relates to the investment casting of superalloy turbine engine components.

Investment casting is a commonly used technique for forming metallic components having complex geometries. It is commonly used in the fabrication of superalloy gas turbine engine components. In an exemplary casting process, a mold is prepared having one or more cavities, each cavity having a shape corresponding to the part to be cast. An exemplary process for preparing the mold involves the use of one or more wax patterns of the part. The patterns may be formed by molding the wax. The molding may be over sacrificial cores (e.g., ceramic cores) generally corresponding to positives of interior passages within the parts. In a shelling process, a ceramic shell is formed around one or more such patterns. The shelling process may involve dipping the patterns in tanks of coating material (e.g., ceramic slurry). Dry particulate may be applied to the wet coated patterns for enhancing structural integrity and the coating layer may then be dried. The process may be repeated to build up multiple layers.

After the shelling, the wax pattern may be removed such as by melting in an autoclave. The hollow ceramic shell may then be strengthened by applying heat. Molten alloy may then be introduced to the shell to cast the part(s). Upon cooling and solidifying of the alloy, the shell (and core, if any) may be mechanically and/or chemically or otherwise suitably removed from the molded part. The part may then be machined and treated in one or more stages.

SUMMARY OF THE INVENTION

One aspect of the invention involves an apparatus for shelling an investment casting pattern. A tank contains a coating material. There are means for holding the pattern immersed in the coating material. There are means for vibrating the pattern during immersion of the pattern.

In various implementations, a pump may be coupled to draw a vacuum around the pattern. The means for vibrating may be mounted to the means for holding. The apparatus may be combined with the coating material being a zircon slurry.

Another aspect of the invention involves an apparatus for shelling an investment casting pattern. A tank contains a coating material. A holding element holds the pattern immersed in the coating material. A vacuum source is coupled to the tank to withdraw air from at least one headspace of the tank.

In various implementations, there may be means for vibrating the pattern during immersion of the pattern. A first such headspace may be within a conduit containing the holding element and extending downward into the tank. A second such headspace may be outside of the conduit. The apparatus may be combined with the pattern, the pattern comprising a ceramic core and a wax layer over at least part of the core. Another aspect of the invention involves a method for shelling an investment casting pattern. The pattern is introduced to a vessel containing a coating material. The pattern is coated with the coating material. A vacuum is drawn in the vessel proximate the pattern. In various implementations, the drawing may include a first drawing with an operative portion of the pattern above a surface level of the coating so as to rupture bubbles in coating material previously applied to the pattern. The pattern may be rotated. The pattern may be vibrated during the rotating. The vacuum may be drawn from a headspace of a conduit partially immersed in the slurry. The drawing may raise a level of the coating material in the vessel from a first height below an operative portion of the pattern to a second height above the operative portion of the pattern. The vacuum may be released so as to drop the level. The vacuum may be redrawn, without immersing the operative portion, so as to encourage the busting of bubbles within a coating of said coating material on said operative portion.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
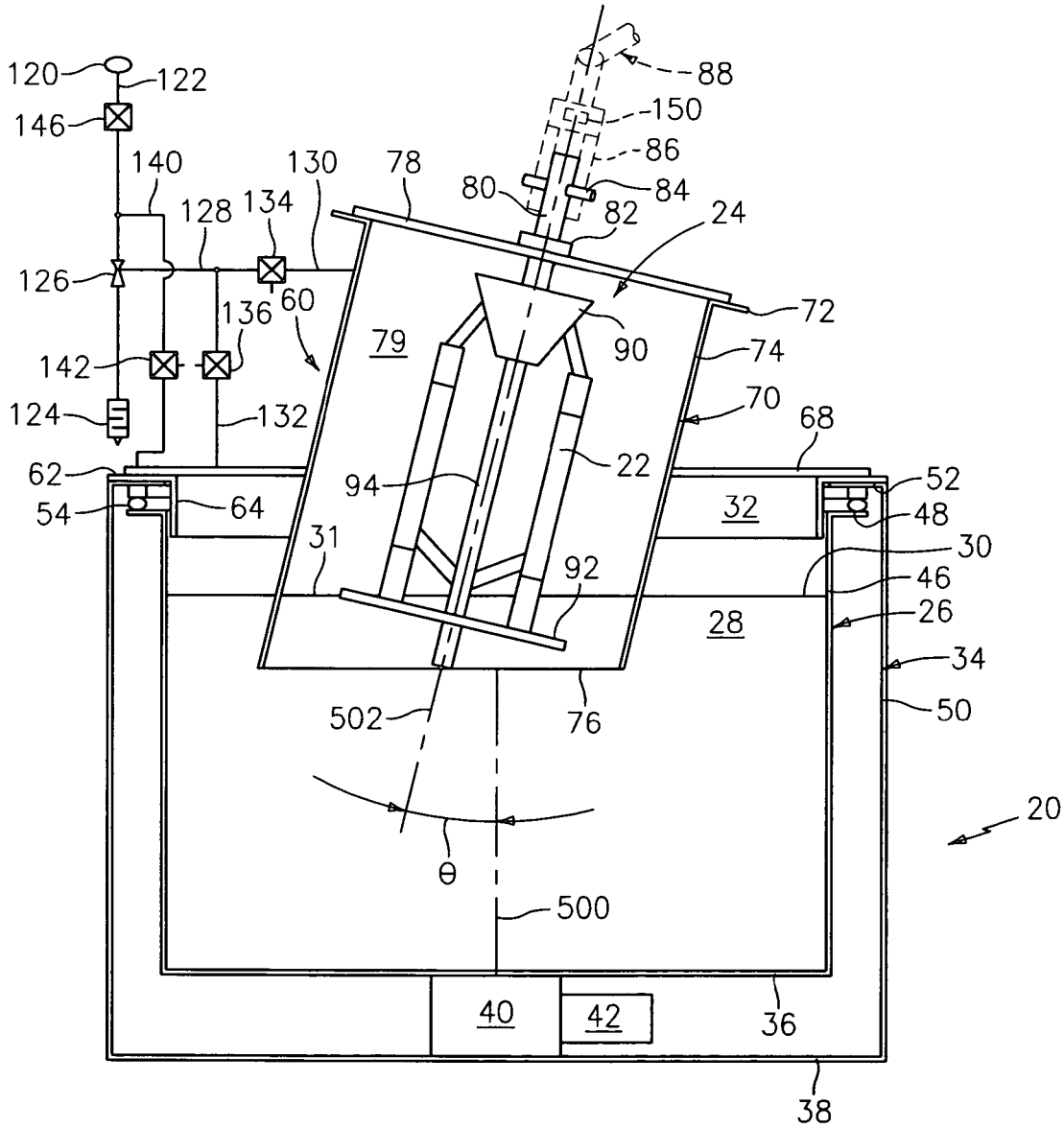
FIG. 1 is a partial side sectional view of a shelling apparatus according to principles of the invention in a first stage of operation.

FIG. 1 shows a shelling system 20 for coating wax patterns 22 held by a fixture 24. A tank 26 contains an at least partially liquid coating material 28 having a surface or meniscus with peripheral and central portions 30 and 31. A tank headspace 32 is located above the meniscus central portion 30. In the exemplary embodiment, the tank 26 is an inner tank having a central vertical axis 500 and laterally surrounded by an outer tank 34. In the exemplary embodiment, the inner and outer tanks have respective bases or bottoms 36 and 38. A bearing and transmission assembly 40 coupled to a drive motor 42 supports the inner tank for rotation about the axis 500 driven by the motor. In the exemplary embodiment, the tank 26 includes a sidewall 46 extending up from the bottom 36 and a horizontal rim flange 48 extending radially outward at the top of the sidewall 46. The outer tank 34 has a sidewall 50 extending up from the bottom 38 and a horizontal rim flange 52 extending radially inward at the top of the sidewall 50 over the flange 48 in parallel facing relation. An inflatable seal 54 is mounted to the underside of the flange 52 and may be inflated to sealingly engage the upper surface of the flange 48 and deflated to disengage.

A tank cover assembly 60 includes a tank engagement piece comprising a horizontal flange 62 and an annular collar 64 depending from an inner diameter of the flange 62 concentrically closely within the rim areas of the tanks 34 and 26 to locate the cover assembly. The underside of the flange 62 may have a seal (e.g., an O-ring—not shown) for sealingly engaging the flange 52. The cover assembly 60 further includes a transverse plate 68 secured atop the flange 62 and spanning the aperture thereof. A shelling tube 70 extends through a central aperture in the plate 68 and is unitarily formed therewith or otherwise sealed/secured thereto. The shelling tube 70 has an upper flange 72 extending radially outward at the top of a sidewall 74. A bottom 76 of the sidewall 74 is immersed within the coating material 28. The underside of a tube lid or cover 78 may bear against and be sealed relative to the flange 72 above a tube headspace 79. The cover 78 is mounted on a shaft 80 of the fixture 24 by means of a rotary bearing/seal 82 passing the shaft through a central aperture in the cover 78 and permitting rotation of the shaft 80 relative to the cover 78 about a common axis 502 of the shaft 80 and tube 70. The exemplary axis 502 is off-vertical at an angle θ relative to the tank axis 500. An upper end of the shaft 80 bears features (e.g., a crossbar 84) to permit grasping by a hand or other end effector 86 of a robot arm 88. The robot arm 88 may, accordingly, carry the fixture 24 and cover 78 as a unit.

The exemplary fixture 24 further includes upper and lower end portions 90 and 92 connected by the patterns or by one or more structural members 94 (e.g., longitudinal rods).

Means may be provided for selectively applying vacuum to the tube headspace 79 and the tank headspace 32 and inflating/deflating the seal 54. Exemplary means are pneumatic, utilizing air from a source 120 such as shop air. A line 122 extends from the source 120 downstream to discharge from a muffler 124. A venturi 126 is located within the line 122 to act as a pump to provide vacuum to a branch line 128. The branch line 128 itself has branches 130 and 132 to the tube and tank headspaces 79 and 32, respectively. In the exemplary embodiment, valves 134 and 136 are respectively located in the branches 130 and 132 for controlling the application of vacuum to the headspaces 79 and 32. Exemplary valves 134 and 136 may have at least two conditions: a first condition exposing the associated headspace to vacuum; and a second condition venting the associated headspace to atmosphere. Yet an additional condition may simply seal the headspace without exposure to vacuum. An additional branch line 140 may connect between the main line 122 and the seal 54. In the exemplary embodiment, a valve 142 is located in the branch line 140 for selectively exposing the seal 54 to pressure to inflate the seal or venting the seal to atmosphere to deflate the seal. An additional overall control valve 146 may be located in the line 122 to block/open the pneumatic system.

Figure 2:
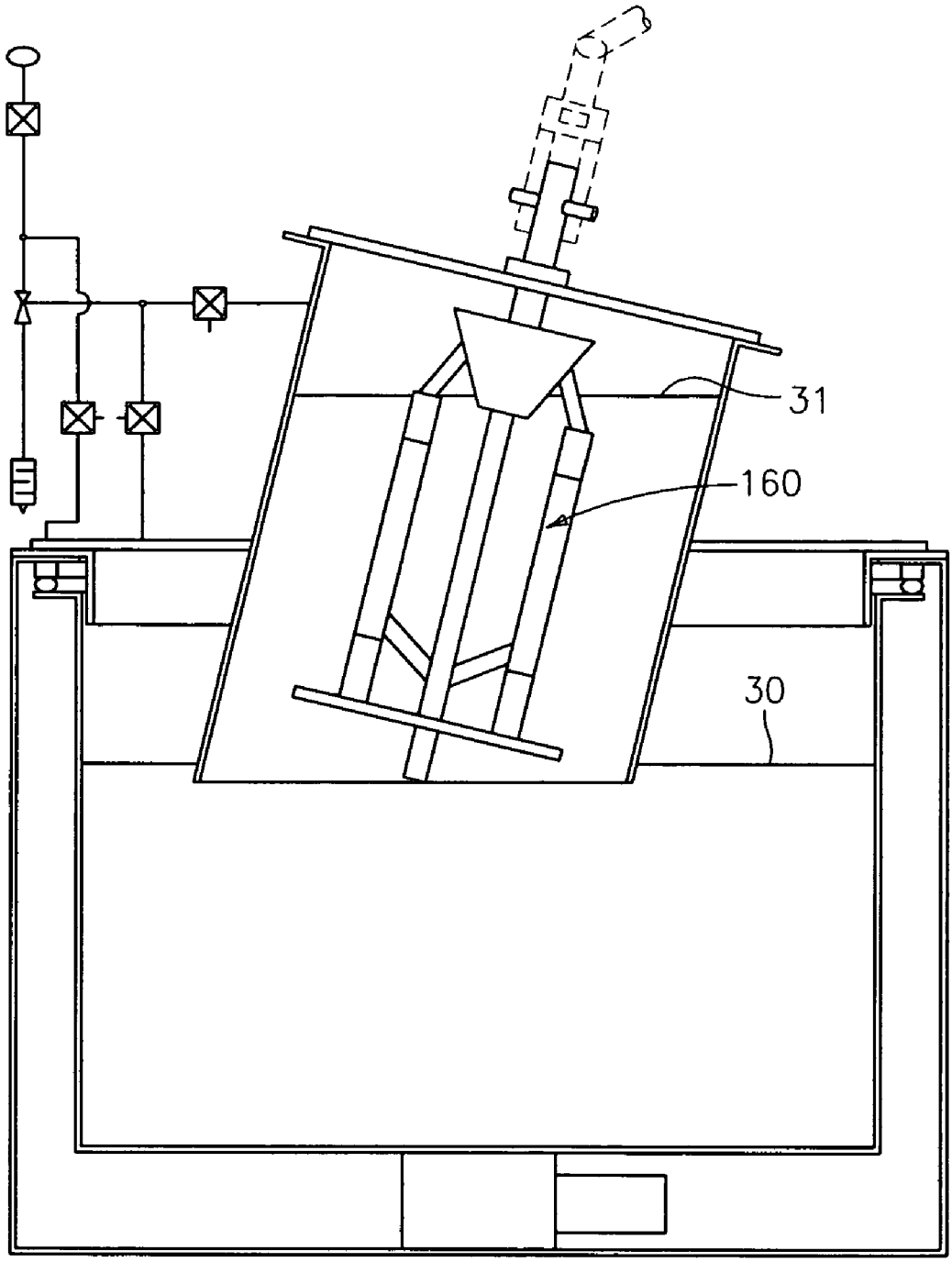
FIG. 2 is a view of the apparatus of FIG. 1 in a second stage of operation.

The normal rotation of the inner tank 26 serves to maintain the coating material in a thoroughly mixed state. A stirring member (stirrer—not shown) may extend into the coating material 28. The stirrer may be stationary as the inner tank rotates. Alternatively, the stirrer may itself move (e.g., being rotated about a local axis—not shown). In the exemplary embodiment, between coating stages (e.g., when there are no fixture and patterns present) the seal 54 may be in its disengaged condition while the inner tank 26 rotates. The tube 70 may be open at its top or another temporary removable cover (not shown) may be installed. In an exemplary application of a given coating layer to the patterns, the inner tank rotation may be stopped and the seal 54 inflated/engaged. The tube headspace 79 and tank headspace 32 may both be exposed to atmospheric pressure. Accordingly, the meniscus portion 31 may be at the same level as the meniscus portion 30. The temporary cover (if any) may be removed and the robot arm 88 will bring the fixture into the tube, with normal force (e.g., along the axis 502) maintaining a seal between the cover 78 and flange 72. At this point, the fixture and patterns may be partially immersed in the coating material. Vacuum is drawn from the tube headspace 79 raising the meniscus 31 above the meniscus 30 (FIG. 2), thereby further immersing the fixture and patterns and preferably completely immersing the operative portions 160 of the patterns. During the immersion, the robot arm 88 may optionally rotate the fixture about the axis 502 so as to fully coat the patterns. Additionally, the robot arm 88 may optionally vibrate the fixture so as to improve wetting of the pattern surfaces and/or draining of slurry therefrom. Exemplary vibration may be achieved by means of a vibration unit 150 mounted to the end effector 86. An exemplary vibration unit is a plate-mount turbine. Alternatives include pneumatic and electric vibrators.

After an appropriate immersion interval, it may be desired to drain excess coating from the pattern operative portions. In the exemplary embodiment, this may be achieved by venting the tube headspace 79 to atmosphere permitting reequalization of the slurry levels (advantageously below the pattern operative portions 160). To then help eliminate bubbles in the coating, vacuum may be drawn from both headspaces 79 and 32 with the surface levels thus remaining the same. The decrease in pressure within the headspace 79 will help rupture the bubbles. After an appropriate bubble-rupturing interval, the headspaces may again be vented to atmosphere. In the exemplary embodiment, the robot arm 88 then rotates the fixture about the axis 502 while vibrating the fixture so as to drain excess slurry, leaving the coating layer of a desired thinness. The robot arm may withdraw the fixture 24 while maintaining the rotation and vibration. The robot arm may then bring the fixture and patterns to additional stages. An exemplary following stage involves the application of solid particles (so-called stucco) to the liquid coating layer. This may be done via known or other rain sanding or barrel sanding techniques or via fluidized bed technology. After particle application, the particle-covered coating layer may be dried (e.g., in an oven). After drying of such layer, further layers may be similarly applied via liquid and particulate stage or liquid-only stage combinations. In exemplary embodiments, each liquid stage may involve a separate tank having appropriate coating material with the single robot being used to transport each given fixture from station to station. In the exemplary embodiments, the initial stages involving applying the coating layers to fine features may be performed with variations on the aforementioned vacuum process. Once the fine details are covered, subsequent layers may be applied via conventional atmospheric dipping.

An exemplary implementation involves forming a shell for the casting of articles with fine complex external features of alloys having highly reactive components. Exemplary active components are hafnium (Hf) and yttrium (Y). With such alloys, it is advantageous that the innermost mold layer (resulting from the first coating layer applied to the pattern) be nonreactive with such components. Exemplary coating material for such first or face coat is formed by refractory $ZrSiO_4$ (zircon) slurry and $Al_2O_3$ (alumina) particulate sand. Exemplary material for subsequent coats are more conventional mixtures of $SiO_2$ (silica) and alumina, although the zircon-alumina mixture may form more than just the face coat (e.g., the first two or three coats).

One or more embodiments of the present invention have been described. Nevertheless, it will be understood that various modifications may be made without departing from the spirit and scope of the invention. For example, the process may make substantial use of existing tanks, fixtures, and other equipment. The features of such existing equipment may influence any associated implementation. Similarly, the process may be used to shell a variety of forms of pattern. The particular patterns may influence the particular coating material(s) and operational parameters. The ability to selectively apply vacuum to the two headspaces may facilitate other combinations of processing steps, including steps wherein different levels of vacuum are applied to the two headspaces and wherein the surface level within the tube is lower than the level outside the tube. In yet further variations, positive pressures may be applied in one or both of the headspaces to achieve a desired effect. Accordingly, other embodiments are within the scope of the following claims.

What is claimed is:

1. An apparatus for shelling an investment casting pattern comprising:

a tank for containing a coating material;

means for holding the pattern immersed in the coating material; and means for vibrating the pattern during immersion of the pattern; a conduit extending partially within the tank; and means for raising and lowering a level of said coating material in the conduit to selectively immerse and expose said pattern and selectively expose said pattern to vacuum.

2. The apparatus of claim 1 further comprising:

a pump coupled to draw a vacuum around the pattern.

3. The apparatus of claim 1 wherein:

the means for vibrating is mounted to the means for holding.

4. The apparatus of claim 1 wherein:

the means for vibrating comprises a plate mount turbine.

5. The apparatus of claim 1 in combination with:

the coating material being a zircon slurry.

6. An apparatus for shelling an investment casting pattern comprising:

a tank for containing a coating material;

a conduit extending partially within the tank;

a holding element for holding the pattern immersed in the coating material; and a vacuum source coupled to the tank to withdraw air from at least one headspace of the tank and coupled to the conduit for raising and lowering a level of said coating material in the conduit.

7. The apparatus of claim 6 further comprising:

a motor coupled to the tank to rotate the tank.

8. The apparatus of claim 7 wherein the tank is an inner tank and the apparatus further comprises:

an outer tank, containing the inner tank.

9. The apparatus of claim 7 further comprising:

said conduit extending partially within the tank and supported by a static structure held to not rotate with the tank when the tank is rotated by the motor.

10. The apparatus of claim 9 further comprising:

an inflatable seal positioned to seal a cover plate of said structure to said tank.

11. The apparatus of claim 9 further comprising:

a removable cover sealed to the conduit and passing a shaft of said holding element.

12. The apparatus of claim 11 wherein:

the removable cover passes the a shaft while permitting rotation of the shaft about a shaft axis off vertical.

13. The apparatus of claim 6 further comprising:

a motor coupled to the tank to rotate the tank about an essentially vertical axis.

14. The apparatus of claim 6 further comprising:

means for vibrating the pattern during immersion of the pattern.

15. The apparatus of claim 6 wherein:

a first said headspace is within a conduit containing the holding element and extending downward into the tank; and a second said headspace is outside of the conduit.

16. The apparatus of claim 15 wherein:

the vacuum source is coupled to the first and second headspaces by one or more valves permitting independent withdrawal of the air from the first and second headspaces.

17. The apparatus of claim 6 in combination with:

the pattern, the pattern comprising a ceramic core and a wax layer over at least part of the core.

* * * * *